United States Patent [19]

Martin et al.

[11] Patent Number: 4,475,584

[45] Date of Patent: Oct. 9, 1984

[54] DOUBLE-TUBE RADIATOR

[75] Inventors: Hans Martin, Stuttgart; Kurt Scharpf, Mönsheim, both of Fed. Rep. of Germany

[73] Assignee: Suddeutsche Kuhlerfabrik Julius Fr. Behr GmbH & Co. KG, Fed. Rep. of Germany

[21] Appl. No.: 307,297

[22] Filed: Sep. 30, 1981

[30] Foreign Application Priority Data

Oct. 10, 1980 [DE] Fed. Rep. of Germany ..... 3038346

[51] Int. Cl.[3] ..... F28F 7/00

[52] U.S. Cl. ..... 165/76; 165/154; 285/161

[58] Field of Search ..... 165/154, 155, 156, 76; 29/157.3 C; 285/161

[56] References Cited

U.S. PATENT DOCUMENTS

| | | | |
|---|---|---|---|
| 1,024,436 | 4/1912 | Cartault | 165/154 |
| 2,410,912 | 11/1946 | Wenk | 165/154 |
| 4,094,358 | 6/1978 | Neveux | 165/154 |
| 4,146,088 | 3/1979 | Pain | 165/141 |

FOREIGN PATENT DOCUMENTS

| | | | |
|---|---|---|---|
| 402788 | 9/1968 | Australia | 165/141 |
| 105127 | 4/1917 | United Kingdom | 165/154 |
| 1590196 | 5/1981 | United Kingdom | 165/141 |

*Primary Examiner*—Sheldon J. Richter
*Assistant Examiner*—John F. McNally
*Attorney, Agent, or Firm*—Craig & Burns

[57] ABSTRACT

A double-tube radiator composed of at least one double tube, preferably of aluminum, the tube being composed of two tubes arranged concentrically, one inside the other, with distributor stubs disposed at their end areas. Each of the stubs have a neck with a supply channel running perpendicular to the longitudinal axes of the tubes, through which neck the oil or the like to be cooled is fed to or removed from the double tube. Provision is made for the distributor stubs to be designed as a sealing plug with cylindrical connecting areas mountable coaxially to the ends of the inner and outer tubes forming the double tube, said plug being provided with a chamber communicating with the supply channel, said chamber being located between the connecting areas for the tubes. The distributor stubs in the form of sealing plugs are drawn over the end areas of the double tube and held there securely, without welding of the inner and outer tubes forming the double tube, or soldering or welding of the distributor stub itself to the outer tube for securing it axially, so that aluminum tubing can be used for the double tube, for example, permitting a high degree of heat-exchanger efficiency to be achieved.

11 Claims, 6 Drawing Figures

DOUBLE-TUBE RADIATOR

BACKGROUND AND SUMMARY OF THE INVENTION

The invention relates to a double-tube radiator, composed of at least one double tube, preferably of aluminum, said tube being composed in turn of two tubes fitted concentrically one inside the other, said tubes having distributor stubs disposed at their end areas, each stub having a neck with a supply channel, running at right angles to the longitudinal axis of the tube, through which neck the oil or the like to be cooled is supplied to or removed from the double tube.

Such double-tube radiators are known. They are used, for example, to cool lubricating oil in engines or transmission oil in torque converters, automatic transmissions and the like in motor vehicles. In order to keep the heat-exchanging capacity at a high level, double tubes made of copper or aluminum are known to be used, wherein the oil is guided in the space between the tubes and therefore cooled from the inside and outside. In the known designs, the oil to be cooled is guided to the double tubes by distributor stubs disposed in the boundary areas of said double tubes. The double tubes are welded together in the vicinity of their ends. The distributor stubs are then soldered to the outer tubes. German Offenlegungsschrift No. 26 12 416 teaches such a double-tube radiator, wherein the distributor stubs are each composed of two parts. A tight connection between the distributor stub and the outer tube is created by screwing the neck of the distributor stub down so that a bead abuts the stub and provides a seal, with the seal improving directly as a function of the amount the neck is screwed into the stub. The disadvantage of the known designs is that the tubes must be cleaned internally after the two tube ends are welded or soldered; this is quite difficult. In addition, mechanical stresses are created by the difference between the thermal expansion coefficients of the water which is usually used for cooling and the oil to be cooled; this often causes leaks in the vicinity of the soldered joints. Still further, these known double-tube radiators can be disassembled only with difficulty, if at all, for cleaning.

Therefore, objects of the invention are to provide a double-tube radiator wherein the distributor stubs can be mounted on the double tubes without requiring soldering or welding, can easily be manufactured and/or repaired, and is immune to temperature-related leaks.

These objects are achieved in accordance with a preferred embodiment of the invention by equipping the distributor stubs with sealing plugs having cylindrical connecting areas, which can be mounted coaxially on the ends of the inner and outer tubes forming the double tube, each of said plugs being provided with a chamber communicating with a supply channel, said chamber being located between the connecting areas for the tubes. An important advantage of the present invention lies in the fact that the distributor stubs can be pushed over the ends of the tubes forming the double tube as plug-type connectors. The tubes thus come to rest against the corresponding cylindrical connecting areas provided on the distributor stubs. The endwise closure of the channel formed between the double tubes is also formed by the distributor stubs in the form of sealing plugs, so that the tubes need no longer be welded together endwise. Likewise, it is no longer necessary to solder the distributor stubs on the tubes or to fasten them otherwise, since the stub can be so adjusted in its connecting areas that an additional seat is ensured for the distributor stub on the tubes. The liquid to be cooled is fed through a supply channel to a chamber, likewise located in the distributor stub, said chamber being located between the connecting areas for the tubes and therefore feeding the liquid to be cooled, oil for example, into the channel between the tubes.

It is advantageous to design the chamber as part of a bore running coaxially to the axes of the tubes, said bore being provided on one side of the inlet of the supply channel with a connecting area for the inner tube, whose diameter corresponds to the outside diameter of the inner tube and merges with a connecting area for the outer tube on the other side of this inlet. Thus, the distributor stub has a bore whose diameter corresponds to the outside diameter of the inner tube on one side of the inlet of the supply channel, the inner tube being held in this area, and on the other side of the inlet, the bore has a diameter larger than the diameter in the connecting area of the inner tube, whereby the chamber can be formed in simple fashion. Since the connecting areas for the tubes are provided on the opposite ends of the coaxial bore, the outer tube is shorter than the inner tube inserted in the bore.

When the bore is provided, in a central area of the distributor stub, with a diameter which is less than the outside diameter of the outer tube and larger than the outside diameter of the inner tube, the chamber is produced in this area and runs coaxially to the longitudinal axes of the tubes. This permits the liquid to be cooled to be introduced over the entire circumferential area of the chamber, so that larger quantities of liquid to be cooled can be supplied without difficulty.

The connecting area for the outer tube consists, in a very advantageous fashion, of a cylindrical stub whose outside diameter corresponds to the inside diameter of the outer tube. In this embodiment, the inner tube is then received in the bore of the distributor stub and the outer tube is fastened at its outer circumference in the vicinity of the cylindrical stub. Since this causes the outer tube to extend over the cylindrical stub of the distributor stub, the heat-exchanger walls are enlarged without necessitating an increase in the size of the distributor stub. This results in a high degree of heat-exchanger efficiency. Moreover, this can also result in a relatively large throughput cross section between the two tubes, thus facilitating the introduction of larger quantities of fluid.

The manufacture of this cylindrical stub can be accomplished in simple fashion if the cylindrical connecting stub is part of a housing wall which surrounds the bore running coaxially to the axes of the tubes, said wall merging with the end away of the cylindrical stub in the connecting area for the inner tube.

It is advantageous for the connecting areas for the tubes to be provided with annular grooves for mounting sealing rings. The sealing rings can be mounted in these grooves to act as sealing elements and to provide an elastic seat for the distributor stub on the double tube. The sealing rings are mounted before the stub is pushed on, and compressed during the pushing-on process so as to form a tight seal, whereby expansion of the tubes and distributor stub owing to different temperature gradients can be compensated for. This, therefore, ensures a tight, elastic, and reliable seat for the distributor stub on the tubes. In particular, in an embodiment in which the outer tube is pushed over the outside of a cylindrical stub, only the sealing ring for the inner tube need be inserted within the bore. The second ring can be easily installed on the outside circumference of the stub in an annular groove provided therefor.

It is also possible to provide the connecting area for the outer tube in the bore next to the connecting area for the inner tube, whereby the outer tube then has an outer diameter corresponding to an inside diameter of the bore. In this case, the outer tube will also fit inside the bore of the stub. Inside, then, the bore will have these three areas of different diameters, whereby the chamber is formed in the middle area, the area of smallest diameter forms the connecting area for the inner tube, and the area of the largest diameter forms the connecting area for the outer tube. When the stub is pushed over the tubes, it strikes a stop, since it can only be pushed on until the outer tube strikes at the beginning of the middle bore, which has a smaller diameter than the outer diameter of the outer tube. Thus, the position of the stub is fixed in the axial direction toward the middle of the double tube.

In another advantageous embodiment of the invention, provision is made for the inner tube to have a length such that when the stub is mounted, it projects endwise beyond the stub in the axial direction. This end can then be bent, after applying the distributor stub, whereby a bilateral locking of the distributor stub on the double tube is accomplished along with the stop in the stub caused by the middle diameter of the bore. However, because the parts can be disassembled or replaced more easily, the inner tube is usually not crimped over the end of the stub.

Advantageously, provision is also made to equip the stub with a round, horizontal collar having an annular groove provided in the neck thereof, and to provide the neck of the stub with a thread. This enables a double-tube radiaton according to the invention to be fastened in simple fashion to a water radiator, for example, whereby a sealing ring mounted in the annular groove is pressed against the wall of the water tank by screwing down a screw mounted above the neck of the stub, thereby providing both a tight seal and a tight seat for the double-tube radiator. However, the double-tube radiator can also be mounted with spring elements (c.f. German Gebrauchsmuster No. 7713703).

To make it easier to slide the stub on the double tube, it is desirable to provide a transition from the bore in the middle area to the area of smallest diameter, as well as the ends of the bore, with bevels. These bevels make it easier to slide the parts together because these bevels guide the tubes into the bores when they are slid together. No such bevel is provided at the transition from the bore between the area of largest diameter and the area of medium diameter, since this transition serves as a stop for the outer tube.

A stub of this kind can be manufactured cheaply and economically as a casting. It can also be advantageous to make it in the form of an extruded section stamped or molded in a die, into which section the bore with the corresponding diameters can subsequently be formed.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
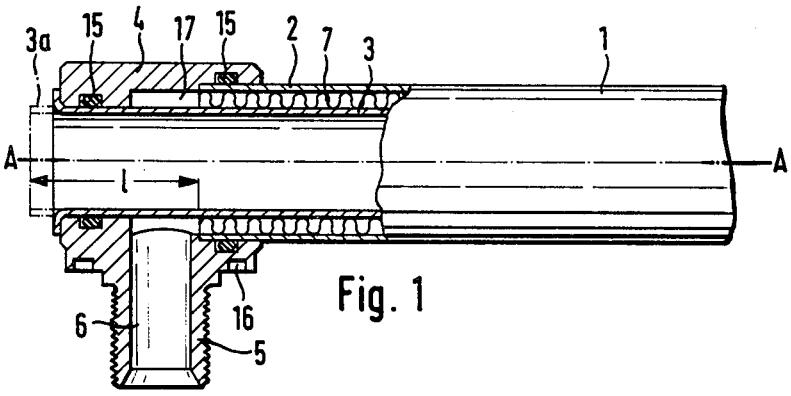
FIG. 1 is a cross section through a stub according to a preferred embodiment of the invention, mounted on a partially shown double tube.

Throughout the description of the several embodiments of the invention, common reference numerals are used for like elements.

FIG. 1 shows a double-tube radiator according to the invention, comprising a double tube designated 1, of which a part can be seen. A one-piece stub 4 according to the invention is pushed onto both ends of the double tube 1, only one stub being shown. Stub 4 is provided with a neck, having a supply opening or channel 6, through which oil to be cooled can be introduced into the area between the two tubes 2 and 3 of double tube 1. Usually, a turbulence insert designated 7 is located between tubes 2 and 3. Double-tube radiators of this kind are mounted in water tanks, with the oil then being cooled by having cooling water flow around the oil located between the tubes, both on the inside and outside.

Figure 2:
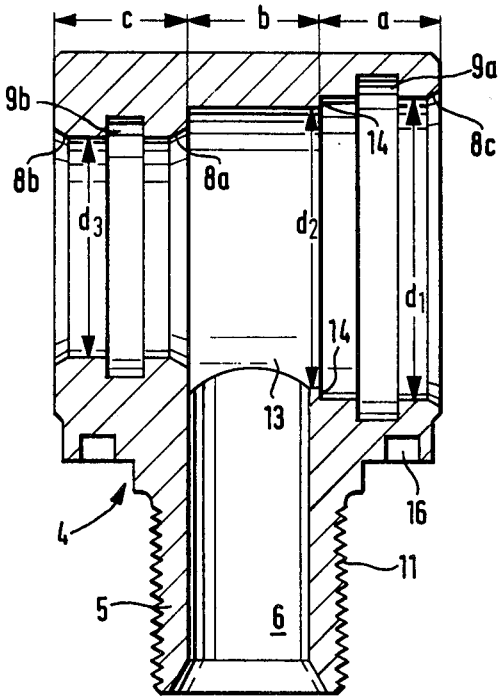
FIG. 2 is a cross section through a stub according to the FIG. 1 embodiment of the invention.

FIG. 2 shows a cross section through the stubs shown in FIG. 1 on an enlarged scale. The one-piece body is provided with a bore 13 which runs coaxially to double tube axis A—A, said bore essentially having three areas a, b, and c of different diameters $d_1$, $d_2$, $d_3$, respectively. The area of smallest diameter c is at an end of the stub furthest from the end of the double tube that is not shown and has a diameter $d_3$, which corresponds to the outside diameter of inner tube 3 of double tube 1. This area forms the cylindrical connecting area for the inner tube. Adjacent to area c is area b, whose diameter is kept between the value of outside diameter $d_1$ and $d_3$ of outer tube 2 and inner tube 3. Thus, a chamber 17 is formed in this area, chamber 17 being located between connecting areas a and c for tubes 2 and 3. Area a, which is located closest to the unshown end of the double tube, has the same outside diameter $d_1$ as outer tube 2. The transition 8*a* between middle area b and area c is beveled, as are the outer ends 8*b* and 8*c* of bore 13. Annular grooves 9*a* and 9*b* are provided in areas a and c, and each serve to receive a sealing ring 15. As can also be seen from FIG. 1, the two tubes 2 and 3 are made of different lengths, so that inner tube 3 is longer than outer tube 2.

To mount stub 4, the latter is pushed over the ends of double tube 1, slid sideways, and initially receives longer inner tube 3. This continues until stop 14, forming the transition between areas a and b, comes into contact with outer tube 2. The tubes will then not slide together any further. Inner tube 3 will then have been pushed through the stub until its end 3*a* projects beyond the end of the stub. It can be pushed in up to this point very simply, since bevels 8*c* and 8*a* facilitate the sliding process. Sealing rings 15, previously installed in grooves 9a and 9b, provide the stub with a very tight and reliable seat on the double tube, which then acts as a sealing plug to block the channel formed between inner tube 3 and outer tube 2. End 3a of inner tube 3 can now be crimped as well, so that the stub can no longer slide, even axially, relative to double tube 1.

Figure 3:
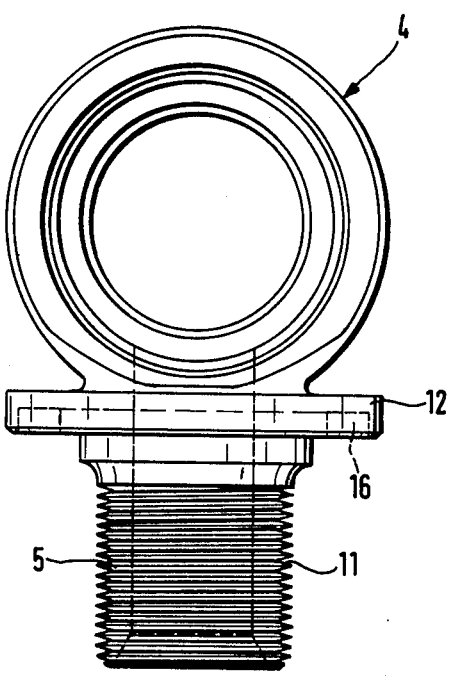
FIG. 3 is a front view of a stub according to FIG. 2.
Figure 4:
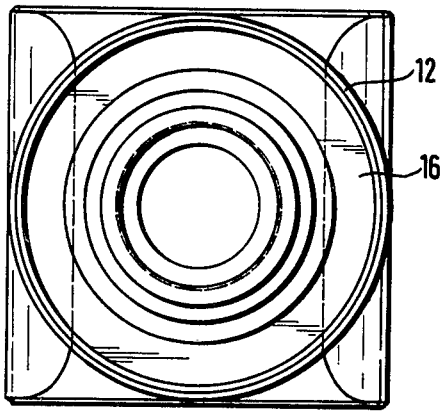
FIG. 4 is a top view of the stub according to FIG. 2.

As FIG. 3 shows, the stub is provided with a collar 12 which, as shown in FIG. 4, has a round surface. An annular groove 16 pointing toward neck 5 is provided in this collar 12, into which groove a sealing ring is fitted, said ring permitting the double-tube radiator to fit tightly in a cooling water tank. Neck 5 has a thread 11 which permits the double-tube radiator to be screwed reliably and tightly to a water tank, for example. Such a stub 4, according to the invention, can be mounted without soldering or welding. The fact that diameters $d_1$ and $d_3$ of bore 13 are adjusted to the diameters of tubes 2 and 3, thereby forming the connecting areas, permits the stub to fit tightly on the end of the double tube, which is raised by the annular grooves 9a and 9b and sealing rings 15 located therein. In addition, no welding is required for axial immobilization since this can be accomplished by means of inner stop 14 and the crimping of end 3a of inner tube 3.

Figure 5:
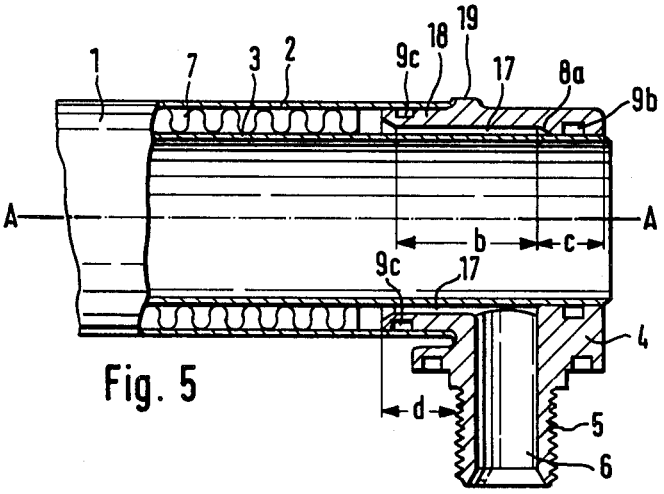
FIG. 5 is a cross section through a stub according to a second embodiment of the invention, mounted on a partially shown double tube.

FIG. 5 shows another embodiment of a stub according to the invention. By contrast with the stub shown in FIG. 1, in this embodiment, outer tube 2 is pushed externally over cylindrical stub 18 formed on the stub, whereby connecting area d for the outer tube is created on the circumferential area of this stub 18. A circumferential annular groove 9c, which opens radially outwardly, is provided on this cylindrical stub, said groove serving to accept a sealing ring, not shown in greater detail, which can provide a reliable seal. Connecting area c for the inner tube is made in the same way as in the embodiment shown in FIG. 1. Middle area b, which consists of a bore with a larger diameter than the diameter in the connecting area c for the inner tube. Connecting area c for inner tube 3 axially adjoins chamber forming area b and with a transition bevel 8a therebetween. Chamber 17 is connected with supply opening 6 so that, when the fluid to be cooled is introduced into opening 6, it therefore flows around inner tube 2 in the vicinity of chamber 17 and is introduced into the channel formed between the two tubes 2 and 3. A projection 19, which is circumferential and serves as a stop for tube 2, is formed on the outside of the stub. When the stub is pushed on, outer tube 2 reaches both this projection 19 and a point in neck 5 so that it cannot be pushed on any further. Thus, projection 19 is disposed at a corresponding point to the stopping point of outer tube 2 on neck 5 of the stub.

Figure 6:
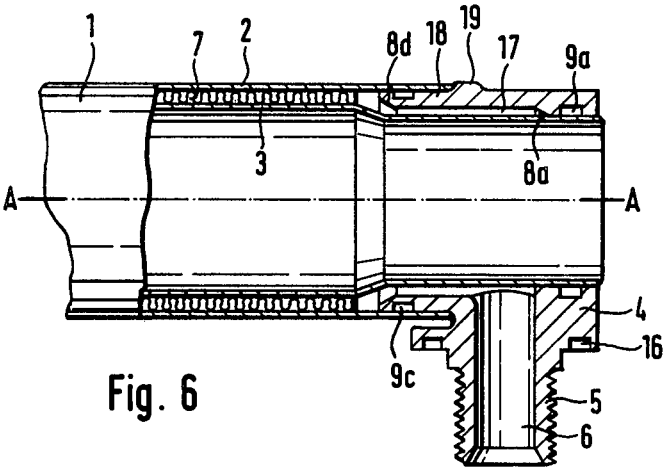
FIG. 6 is a cross section through a stub according to yet another embodiment of the invention, mounted on a partially shown double tube.

By contrast with the embodiment shown in FIG. 5, wherein the channel formed by the two double tubes has a relatively large cross section, in which a correspondingly high turbulence insert is inserted, in the embodiment shown in FIG. 6, the channel formed between the inner and outer tubes is made relatively narrow, in which channel a lower turbulence insert is inserted. Inner tube 3 is tapered at the end in the area where stub 4 is pushed on. Bevels 8d, formed at the end of collar 18 closest to double tube 1, serve both for improved insertion of the inner tube in the bore in stub 4, and form a delimitation of the channel in which the liquid to be cooled is supplied to the double tube from chamber 17. This ensures that there is no narrowing of the cross section for the fluid flowing through in the area where the inner tube makes a transition from its tapered end area to the area of larger diameter. The stub 4 of the FIG. 6 embodiment is the same as that of FIG. 5.

The use of such stubs according to the invention makes it possible to eliminate welding the two tubes 2 and 3 together at their ends, whereby the otherwise necessary internal cleaning of the tubes after welding is likewise rendered super-fluous. If the double-tube radiator requires cleaning after prolonged operation, the distributor stubs can be removed extremely simply, cleaning can be performed, and the stubs can then be pushed together again very simply with a reliable, secure seat. Since no welding is required, such stubs are especially suitable for use in conjunction with aluminum tubes, thus permitting weight savings. Likewise, different thermal expansion coefficients resulting from different temperature gradients can no longer lead to stresses in welded seams which might be present, which have led to leaks in known designs. These differences in expansion between distributor stubs and the double tube can be compensated, in particular, by the sealing rings provided in the annular grooves. A stub of this kind can be manufactured simply and inexpensively as a casting. However, it can also be advantageous to stamp or mold it in a die as an extruded section.

While I have shown and described various embodiments in accordance with the present invention, it is understood that the same is not limited thereto, but is susceptible of numerous changes and modifications as known to those skilled in the art and I, therefore, do not wish to be limited to the details shown and described herein, but intend to cover all such changes and modifications as are encompassed by the scope of the appended claims.

What is claimed is:

1. A pipe cooler comprising at least one double pipe which has inner and outer pipes arranged concentrically one inside the other with distributor members interconnecting the inner and outer pipes at their ends, each distributor member including a neck having a feed channel which extends perpendicularly to the axis of the pipes and through which fluid to be cooled flows, each distributor member being attached in tightly sealed manner by cylindrical connecting zones adapted to fit coaxially to the ends of the inner and outer pipes which form the double pipe, each distributor member having a chamber communicating with the feed channel disposed between the cylindrical connecting zones for the pipes, said chamber being part of a bore which extends coaxially relative to the axis of the pipes and which provides, on one side of the feed channel, a connecting zone for the inner pipe, and a connecting zone for the outer pipe which includes a cylindrical portion concentric with said inner and outer pipes having a diameter which is less than the internal diameter of the outer pipe but greater than the external diameter of the inner pipe, said cylindrical connecting zone for the outer pipe being an externally disposed part of the distributor member surrounding the bore, said cylindrical connecting zones for the pipes including annular grooves for receiving sealing rings.

2. A pipe cooler according to claim 1, wherein the cylindrical connecting zone for the outer pipe is disposed on a cylindrical stub whose outside diameter corresponds to the inside diameter of the outer pipe.

3. A pipe cooler according to claim 2, wherein the cylindrical connecting stub forms part of a housing wall which surrounds said bore.

4. A pipe cooler according to claim 2, wherein the inner pipe is of a length such that when said distributor member is mounted thereon it projects axially endwise beyond the member.

5. A cooler according to claim 1, wherein the double pipe is aluminum.

6. A cooler according to claim 1, wherein a transition of the bore from a middle zone forming the chamber to a connecting zone for the inner pipe, as well as the ends of the bore, has a chamfered area.

7. A cooler according to claim 1, wherein each distributor member is a pressure die casting.

8. A cooler according to claim 1, wherein each distributor member is made by one of pressing and molding in a die as an extruded section.

9. A cooler as set forth in claim 1, wherein the cylindrical connecting zone for the outer pipe is radially spaced relative to the cylindrical connecting zone for the inner pipe.

10. A cooler as set forth in claim 1, wherein the cylindrical connecting zone for the outer pipe is axially spaced relative the cylindrical connecting zone for the inner pipe along the axis of the pipes.

11. A cooler as set forth in claim 10, wherein the cylindrical connecting zone for the inner pipe is axially spaced beyond a respective end of the outer pipe.

* * * * *